US006250242B1

(12) United States Patent
Modes

(10) Patent No.: US 6,250,242 B1
(45) Date of Patent: Jun. 26, 2001

(54) MAINSTAY RIG

(76) Inventor: Larry Modes, 15406 Peermont St., Houston, TX (US) 77062

( * ) Notice: Subject to any disclaimer, the term of this patent is extended or adjusted under 35 U.S.C. 154(b) by 0 days.

(21) Appl. No.: 09/547,410

(22) Filed: Apr. 11, 2000

(51) Int. Cl.[7] ..... B63B 15/00
(52) U.S. Cl. ..... 114/102.12; 114/109; 114/111
(58) Field of Search ..... 114/89, 90, 214, 114/102.1, 102.12, 109, 111

(56) References Cited

U.S. PATENT DOCUMENTS 2,015,000 9/1935 Beringer .
4,672,908 * 6/1987 Goulooze ..... 114/214

* cited by examiner

*Primary Examiner*—Stephen Avila

(57) ABSTRACT

The mainstay rig is an improved standing rig system for wind-powered vehicles that travel on water, snow, ice, land, or rail. Mainstay rig uses a mast at a rake and uses a vertical mainstay to support mainsail luff, which gives less disturbance of airflow at mainsail luff and greater driving force. Mainstay rig can use jib-furling mechanisms for mainsail furling. Mainstay rig eliminates backstay and gives a greater choice of mainsail shape which allows more efficient energy extraction from wind because sails can be shaped with larger roach or be shaped closer to an ideal elliptical shape. Additionally, mainstay rig can use one shroud, which reduces windage.

8 Claims, 3 Drawing Sheets

MAINSTAY RIG

The mainstay rig is an improved standing rig for sailboats and other wind powered vehicles that travel on water, snow, ice, land, or rail.

BACKGROUND

The mainstay rig is an improvement of standing rig contained in claim 1 of U.S. Pat. No. 2,015,000 to Beringer issued Sep. 17, 1935. In mainstay rig, the mainmast of Beringer patent is replaced with a mainstay, and backstay of Beringer patent is eliminated.

The mainstay rig retains auxiliary mast and forestay of Beringer patent. Mainstay rig can be distinguished from other rigs in that mainstay rig has an aftmost stay which is upright or nearly upright, and a sloping mast. Mainstay rig has broader application and is not limited to proportions, sail number, nor sail placements contained in Beringer's claims. Mainstay rig can be further distinguished by additional elements recited below and in the appended claims.

Herein, longitudinal means a fore and aft direction, or nominal direction of vehicle travel; specifically a direction along or parallel to vehicle centerline.

Herein, lateral means a sideways direction, specifically a direction perpendicular to both vehicle centerline and upright.

Herein, upright, when used in regard to water vehicles coincides with vertical when vehicle is at normal trim in still water and calm air; and in regard to other vehicles coincides with vertical when vehicle is normally loaded at rest on a firm, horizontal surface.

Herein, vehicle means, but is not limited to: a boat, sailboat, catboat, lugboat, sloop, cutter, ketch, schooner, yawl, multihull, catamaran, trimaran, proa, iceboat, landsailer, sandsailer, railcar, and sled; including any part which is permanently or temporarily attached in a fixed or moveable manner to vehicle; and which part may be, but is not limited to: backstay tensioner, beam, block, bobkin, bow, bowsprit, bulkhead, car, chainplate, clamp, crosspiece, deck, doghouse, foot, frame, fuselage, gear, gusset, hull, hydraulic tensioning device, keel, partner, plank, plate, post, sheet, spar, sprit, step, strapping, tab, tabernacle, terminal, timber, track, transom, truck, trunk, tube, turnbuckle, or yard.

SUMMARY

Several objects and advantages of mainstay rig are: a mast is replaced by a stay; less disturbance of airflow at mainsail luff; fewer parts; greater choice of mainsail shape; ability to be used with various masts; ability to be used with sails of every type; ability to use internal or external blocks and halyards.

Mainmast, a major compressive element in Beringer patent, is changed in my mainstay rig to a mainstay, a tensile element. This change reduces size, weight, and cost of mainstay rig.

Less disturbance of airflow across mainsail luff is another advantage of mainstay rig. A sail generates a larger forward component and functions more efficiently in clear, undisturbed air. Mainsail luff used with mainstay rig is supported by a stay well clear of mast. Mainsail luff used with mainstay rig is in clear, undisturbed air. Because of these and other factors, there are more advantages than just relocation of airflow disturbance from one place to another when mast is relocated in mainstay rig. Conversely, in Beringer's patent airflow across mainsail luff is adversely disturbed on all headings by mainmast located at leading edge of mainsail.

Fewer parts is an advantage of mainstay rig. Backstay is eliminated in mainstay rig. This elimination advantageously reduces number of parts in mainstay rig and reduces windage.

Greater choice of mainsail shape is an additional advantage of mainstay rig. Shape of mainsail used with mainstay rig is free of restrictions of a backstay. This advantage allows more efficient energy extraction from wind because sails used with mainstay rig can be shaped with larger roach, larger head, full battens, or any combination of them, or can be shaped closer to an ideal elliptical shape. Whereas, on Beringer patent mainsail is adversely limited to a shape able to pass through triangular opening formed by mainmast, backstay, and deck.

An ability to be used with masts of every section, shape, design, and material is one advantage of mainstay rig. Such sections include but are not limited to: open, hollow, and solid; rectangular, octagonal, circular, oval, and strawberry. Such shapes include but are not limited to: straight, simple curved, compound curved, and tapered. Such designs include but are not limited to: single spreader, double spreader, triple spreader, diamond spreader, and no spreader. Such materials include but are not limited to: wood, metal, fiber, plastic, layered, and cored. Any mast able to carry applicable loads is usable with mainstay rig.

An ability to be used with sails of every type, shape, and material is an advantage of mainstay rig. Such types include but are not limited to: lug, gaff, bermuda, boomless, boomed, club-footed, fully-battened, roller-furled, hanked-on, and one, two, three, or more foresails which include but are not limited to jib, genoa, staysail, and spinnaker. Such shapes include but are not limited to: quadrilateral, triangular, full-roached, and batwing. Such materials include but are not limited to: flax, cotton, Nylon, Dacron, Mylar, Kevlar, and layered.

For offshore, coastal, inland, or hard surface racing vehicles an advantage of mainstay rig is ability to use internal blocks and halyards, and to measure base of fore-triangle between forestay and mainstay. For coastal and inland cruising sailboats, and rail vehicles an advantage of mainstay rig is ability to use aligned intermediate stay, mast step, and shroud to steady a self-lowering mast. The mechanism of a self-lowering mast is not part of this application. For world cruising sailboats and other vehicles an advantage of mainstay rig is ability to use external blocks and halyards, and roller furled mainsail similar to roller-furled jib.

Further objects and advantages of mainstay rig will become apparent from a consideration of the drawings and ensuing description.

Figure 1:
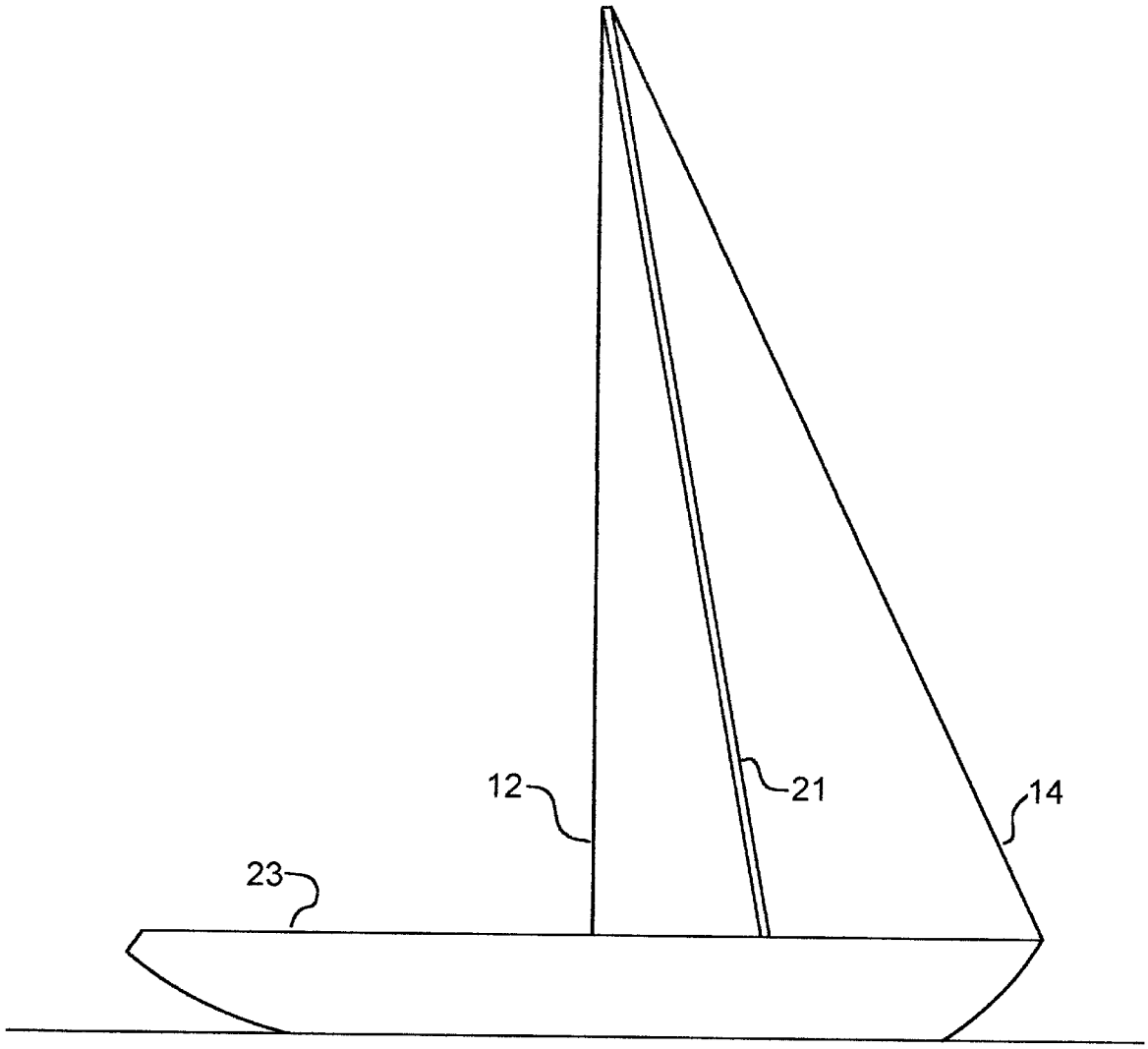
FIG. 1 is a side elevational view of mainstay rig on sailboat.

REFERENCE NUMERALS IN FIGS.

12 Mainstay
14 Forestay
16 Intermediate stay
18 Shroud
21 Mast
23 Vehicle

DETAILED DESCRIPTION

Mainstay rig accomplishes the objects and advantages in one of several embodiments by using the following devices, means, processes, and arrangements:

- mainstay 12 is upright, runs from mast 21 to vehicle 23, is attached to mast 21 at or near top of mast 21, is attached to vehicle 23 at or foreward of rearmost point of vehicle 23, and may support a sail or sails (not shown);
- forestay 14 slants longitudinally, runs from mast 21 to vehicle 23, is attached to mast 21 at or near top of mast 21, is at ed to vehicle 23 at or rearward of foremost point of vehicle 23, and may support a sail or sails (not shown);
- mainstay 12 and forestay 14 define an upright, longitudinal plane (not shown);
- shroud 18 slants laterally and longitudinally, runs from mast 21 to vehicle 23 generally to right of plane of mainstay 12 and forestay 14, is attached to mast 21 at or near top of mast 21, is attached to vehicle 23 to right of plane of mainstay 12 and forestay 14;
- intermediate stay 16 slants longitudinally, runs from mast 21 to vehicle 23, is attached to mast 21 at or near top of mast 21, is attached to vehicle 23 aftward of forestay 14, and forward of mainstay 12, and may support a sail or sails (not shown);
- mast 21 slants both laterally and longitudinally above vehicle 23, is generally to right of plane of mainstay 12 and forestay 14, is attached to upper end of mainstay 12, forestay 14, stay 16, and shroud 18, is attached to vehicle 23 to right of plane of mainstay 12 and forestay 14, but not as far to right as shroud 18 is attached, and may support a sail or sails (not shown);
- elimination of shroud or shroud system on one side of plane of stays and its functional replacement by mainstay 12, forestay 14, and, where present, stay 16; and
- elimination of backstay and its functional replacement by mainstay 12.

FIG. 1 shows side elevation of an embodiment of mainstay rig on a sailboat. Mainstay 12, forestay 14, and shroud 18 support mast 21 on vehicle 23. Mainstay 12 and forestay 14 each can support sails (not shown). Back end of vehicle 23 is at or aft of lower end of mainstay 12. Forward end of vehicle 23 is at or foreward of lower end of forestay 14.

Figure 2:
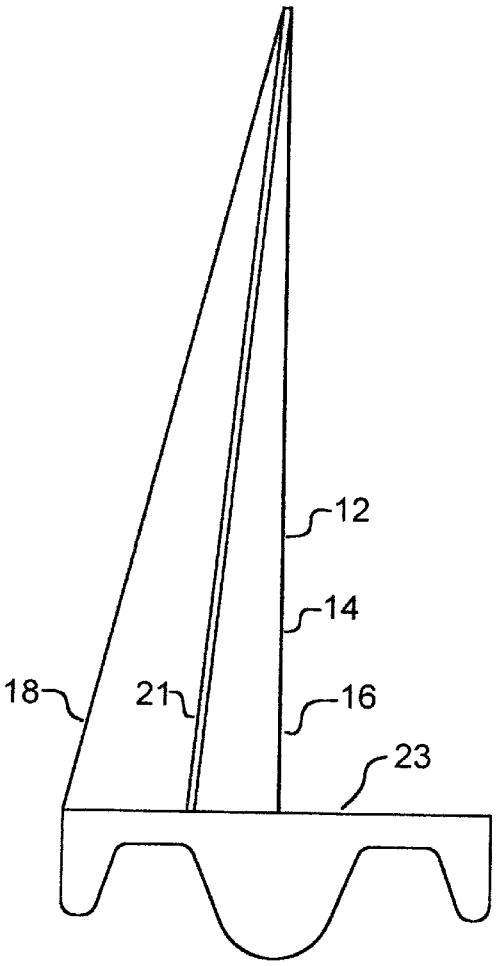
FIG. 2 is an end elevational view of mainstay rig on trimaran.

FIG. 2 shows end elevation of an embodiment of mainstay rig on a trimaran sailboat. Mainstay 12, forestay 14, and stay 16 are in an upright plane of stays. Mainstay 12, forestay 14, and stay 16 each can support sails (not shown). Foot of mast 21 is to left of plane of stays. Lower end of shroud 18 is farther to left of plane of stays than foot of mast 21.

Figure 3:
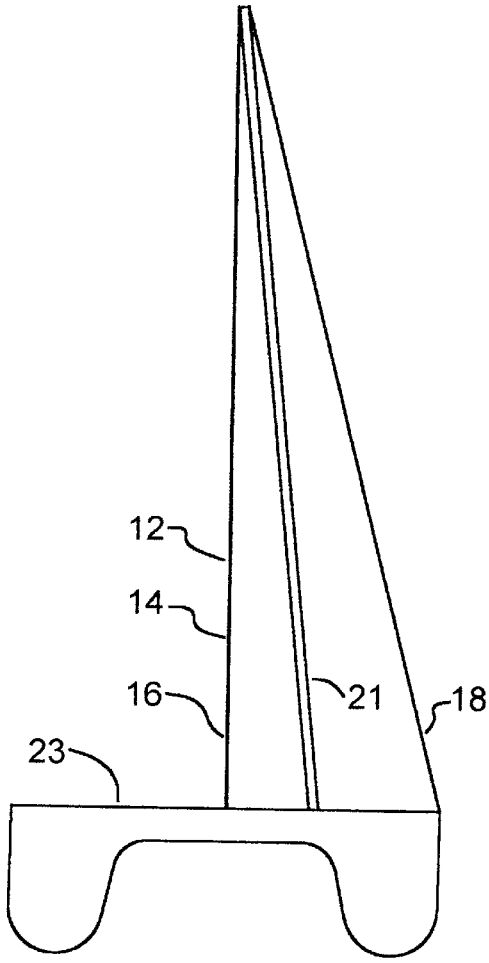
FIG. 3 is an end elevational view of mainstay rig on catamaran.

FIG. 3 shows end elevation of an embodiment of mainstay rig on a catamaran sailboat. Mainstay 12, forestay 14, and stay 16 are in an upright plane of stays. Mainstay 12, forestay 14, and stay 16 each can support sails (not shown). Foot of mast 21 is to right of plane of stays. Lower end of shroud 18 is farther to right of plane of stays than foot of mast 21.

Figure 4:
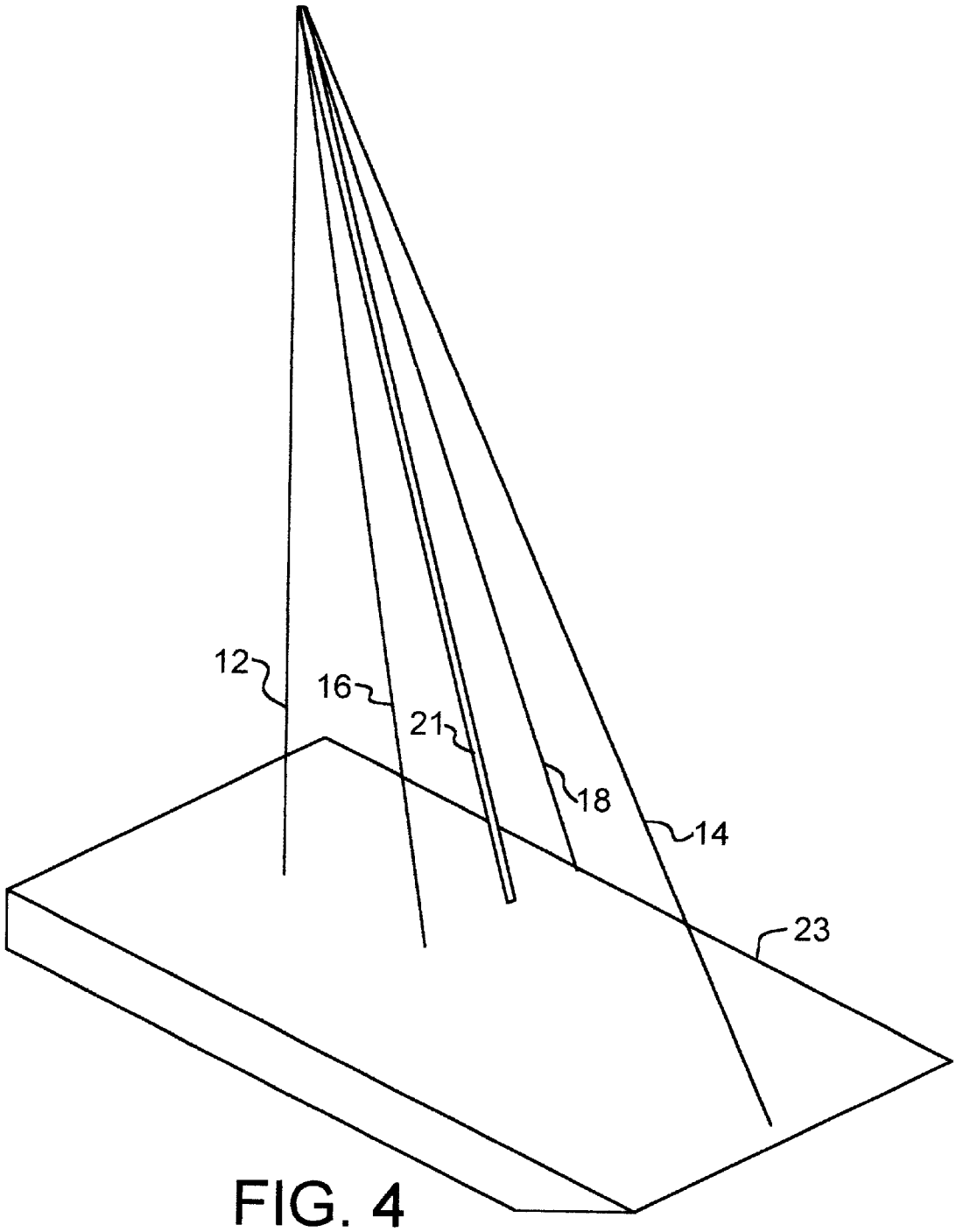
FIG. 4 is a perspective view of mainstay rig on a catamaran.

FIG. 4 shows perspective of an embodiment of mainstay rig on a catamaran sailboat. Mainstay 12, forestay 14, and stay 16 are in an upright plane of stays. Mainstay 12, forestay 14, and stay 16 each can support sails (not shown). Foot of mast 21 is to left of plane of stays. Lower end of shroud 18 is farther to left of plane of stays than foot of mast 21.

SCOPE OF INVENTION

While my above description contains many specifications, these should not be construed as limitations on scope of mainstay rig, but rather as exemplifications of preferred embodiments thereof. Many other variations are possible.

An embodiment similar to mainstay rig, as illustrated in FIG. 1, wherein mast is additionally supported by shrouds.

In an embodiment for catamaran, as illustrated in FIGS. 1 & 3, there is an advantageous reduction of stress in cross member supporting mast due to location of mast step at a point on cross member at or near left side of right hull of catamaran.

In an embodiment for trimaran, as illustrated in FIGS. 1 & 2, there is an advantageous reduction of obstruction in interior of center hull due to location of mast step at a point at or near or beyond left side of central hull.

An embodiment for iceboat may be used on hull as in Scooter class type, or on fuselage with cross piece located forward as in Class A or Hudson River type, or fuselage with cross piece located aftward as in Detroit News type, or on fuselage with cross pieces located both forward and aftward.

An embodiment for landsailer may be used on four-wheel frame, or on three-wheel frame with two wheels forward, or on an aftward cross piece as in Class 5 type, or on a frame with tandem wheels parallel to or in plane of stays and a third or fourth wheel located to provide lateral stability.

An embodiment for railcar may have plane of stays at or near right side of vehicle.

Each embodiment which is shown or described as having elements on right side, also has an alternative embodiment wherein those elements are on left side. Each embodiment which is shown or described as having elements on left side, also has an alternative embodiment wherein those elements are on right side.

In an embodiment for proa, as illustrated in FIG. 1 & similar to FIG. 2, a coincidental result is an advantageous reduction of obstructions in interior of main hull due to location of mast step to a point at or near or beyond edge of main hull nearer to centerline of boat.

Each embodiment has alternative embodiments wherein three, two, one, or no stay 16 is present.

The scope of mainstay rig is broader in application than Beringer patent and is not limited by percentages, proportions, numbers of sails, sail placements, or limitations of Beringer patent.

Accordingly, the scope of mainstay rig should be determined not by embodiments illustrated, but by the appended claims and their legal equivalents. Each percentage, angular measurement, or congruent figure in any appended claim is not an element of mainstay rig, but is an inclusive limitation of that claim and its dependent claims.

I claim:

1. A standing rigging system comprising:

a. a compressive means which inclines longitudinally, laterally, or both longitudinally and laterally, which has an upper portion and lower portion, which upper portion interconnects by connection means to upper terminus of tensile means, and which lower portion interconnects by connection means with vehicle at location such that centerline or projected centerline of compressive means passes within a figure which is concentric with, congruent to, and has 76% the area of a quadrangular figure with one vertex at the foremost tensile means, one vertex at the aftmost tensile means, one vertex at the extreme right edge of the vehicle specifically lateral to compressive means, and one vertex at the extreme left edge of the vehicle specifically lateral to compressive means;

b. a foremost tensile means which inclines longitudinally and which has an upper terminus and lower terminus, which upper terminus interconnects by connection means to upper portion of compressive means, and which lower terminus interconnects by connection means to vehicle at or aft of forward extreme of vehicle;

c. an aftmost tensile means which inclines longitudinally by 20.06 degrees or less from upright, which has an upper terminus and lower terminus, which upper terminus interconnects by connection means to upper portion of compressive means, which lower terminus interconnects by connection means to vehicle at or forward of aft extreme of vehicle.

2. The standing rigging system of claim 1 additionally comprising one intermediate tensile means which inclines longitudinally, which has an upper terminus and lower terminus, which upper terminus interconnects by connection means to upper portion of compressive means, and which lower terminus interconnects by connection means to vehicle at location intermediate to lower terminus of foremost tensile means and lower terminus of aftmost tensile means.

3. The standing rigging system of claim 1 additionally comprising two intermediate tensile means which incline longitudinally, which each has an upper terminus and lower terminus, which each upper terminus interconnects by connection means to upper portion of compressive means, and which each lower terminus interconnects by connection means to vehicle at separate locations intermediate to lower terminus of foremost tensile means and lower terminus of aftmost tensile means.

4. The standing rigging system of claim 1 additionally comprising three intermediate tensile means which incline longitudinally, which each has an upper terminus and lower terminus, which each upper terminus interconnects by connection means to upper portion of compressive means, and which each lower terminus interconnects by connection means to vehicle at separate locations intermediate to lower terminus of foremost tensile means and lower terminus of aftmost tensile means.

5. The standing rigging system of claim 1 additionally comprising a lateral tensile means which inclines laterally, or both longitudinally and laterally, which has an upper terminus and lower terminus, which at upper terminus interconnects by connection means to upper portion of compressive means, and which at lower terminus interconnects by connection means to vehicle at or within extreme width of vehicle.

6. The standing rigging system of claim 2 additionally comprising a lateral tensile means which inclines laterally, or both longitudinally and laterally, which has an upper terminus and lower terminus, which at upper terminus interconnects by connection means to upper portion of compressive means, and which at lower terminus interconnects by connection means to vehicle at or within extreme width of vehicle.

7. The standing rigging system of claim 3 additionally comprising a lateral tensile means which inclines laterally, or both longitudinally and laterally, which has an upper terminus and lower terminus, which at upper terminus interconnects by connection means to upper portion of compressive means, and which at lower terminus interconnects by connection means to vehicle at or within extreme width of vehicle.

8. The standing rigging system of claim 4 additionally comprising a lateral tensile means which inclines laterally, or both longitudinally and laterally, which has an upper terminus and lower terminus, which at upper terminus interconnects by connection means to upper portion of compressive means, and which at lower terminus interconnects by connection means to vehicle at or within extreme width of vehicle.

* * * * *